US007122142B2

(12) United States Patent
Chang

(10) Patent No.: US 7,122,142 B2
(45) Date of Patent: Oct. 17, 2006

(54) METHOD FOR COMBINING A METAL RACKET FRAME WITH A GRIP

(76) Inventor: Chen-Chung Chang, No. 912, Chung Shang Rd., Shen Kang, Taichung Hsien (TW) 429

( * ) Notice: Subject to any disclaimer, the term of this patent is extended or adjusted under 35 U.S.C. 154(b) by 423 days.

(21) Appl. No.: 10/790,718

(22) Filed: Mar. 3, 2004

(65) Prior Publication Data

US 2005/0194717 A1 Sep. 8, 2005

(51) Int. Cl.
*B29C 45/14* (2006.01)

(52) U.S. Cl. ..... 264/263; 264/261; 264/328.1

(58) Field of Classification Search ..... 264/263, 264/250, 261, 328.1, 259
See application file for complete search history.

(56) References Cited

U.S. PATENT DOCUMENTS 1,523,638 A * 1/1925 Freedlander et al. ..... 473/549
5,034,082 A * 7/1991 Nolan ..... 156/245
5,282,618 A * 2/1994 Hong ..... 473/523
5,409,218 A * 4/1995 You ..... 473/523
5,620,180 A * 4/1997 Hong ..... 473/521

* cited by examiner

*Primary Examiner*—Edmund H. Lee
(74) *Attorney, Agent, or Firm*—Troxell Law Office, PLLC

(57) ABSTRACT

A method for combining a metal racket frame with a hollow grip includes the following steps: prepare a metal racket frame and a hollow grip in advance, fit two free ends of the metal racket frame in the upper end of the hollow of the hollow grip and then place the fitted portion of the metal racket frame and the hollow grip in a matched mold. After the matched mold is closed and combined together, the matched mold and the metal racket frame with the hollow grip are turned upside down, and liquid resin is injected in the interior of the hollow grip. After the liquid resin is solidified, remove the metal racket frame and the hollow grip from the matched mold, thus finishing the metal racket frame and the hollow grip combined integrally and smoothly.

4 Claims, 8 Drawing Sheets

METHOD FOR COMBINING A METAL RACKET FRAME WITH A GRIP

BACKGROUND OF THE INVENTION

1. Field of the Invention

This invention relates to a method for combining a metal racket frame with a grip, particularly to one able to lighten a racket, having an excellent effect of shock absorption and a smooth and neat appearance after combined.

2. Description of the Prior Art

A conventional method for combining a metal racket frame with a grip is to have a metal tube preset in length bent and shaped in a racket. Next, the racket has its lower portion with a proper length deposited in a matched mold, and then foaming agent is injected into the matched mold. After the foaming agent is solidified, a grip combined with the metal racket frame is obtained.

However, the conventional method for combining a metal racket frame with a grip has the following drawbacks.

1. The foam grip is completely solid so it is too heavy.

2. The metal racket frame has its lower ends extending to the bottom of the grip; therefore, most of the vibration of the racket produced by striking balls will be transmitted to the grip, liable to hurt a user's hand due to vibration.

SUMMARY OF THE INVENTION

The objective of the invention is to offer a method for combining a metal racket frame with a grip, in which a metal racket frame with its two free ends bent in advance is prepared and the two free ends bent are fitted in the upper hollow portion of a grip to form a combined portion, which is then to be placed in preset matched molds. Next, the matched molds are closed, and the metal racket frame together with the grip placed in the molds are turned upside down, letting the hollow grip face upward. Then liquid resin is injected into the hollow grip through its upper opening. After the liquid resin is solidified, the metal racket frame is integrally combined with the hollow grip, taken out of the molds.

By this method, the metal racket frame and the grip can be combined together integrally and smoothly. Further, the hollow grip only has a small part combined with the metal racket frame, while its rest part still remains hollow, able to lighten a racket in a great degree. Furthermore, the metal racket frame and the hollow grip are combined together by means of elastic resin, able to elevate the effect of shock absorption.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
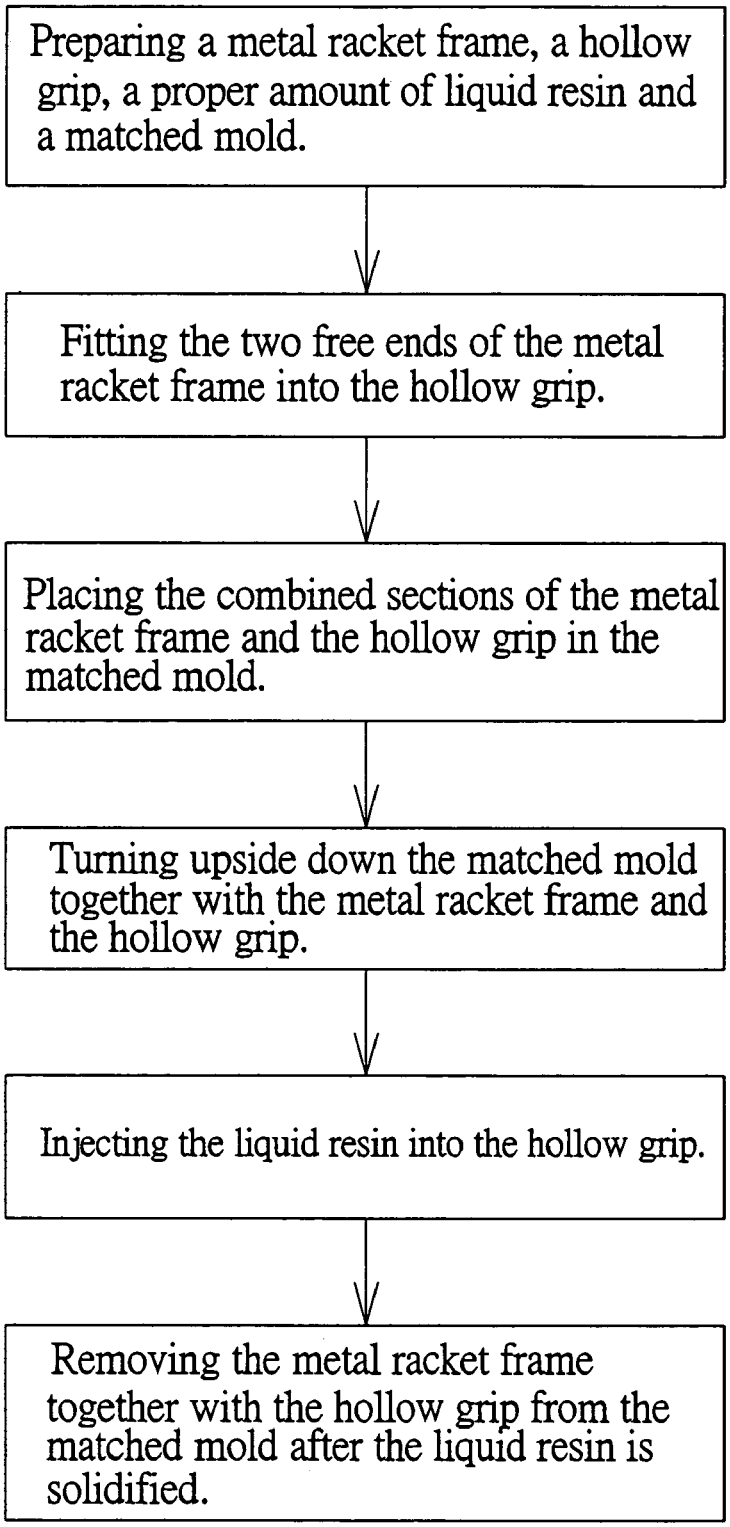
FIG. 1 is a block chart of a method of combining a metal racket frame with a grip in the present invention.
Figure 2:
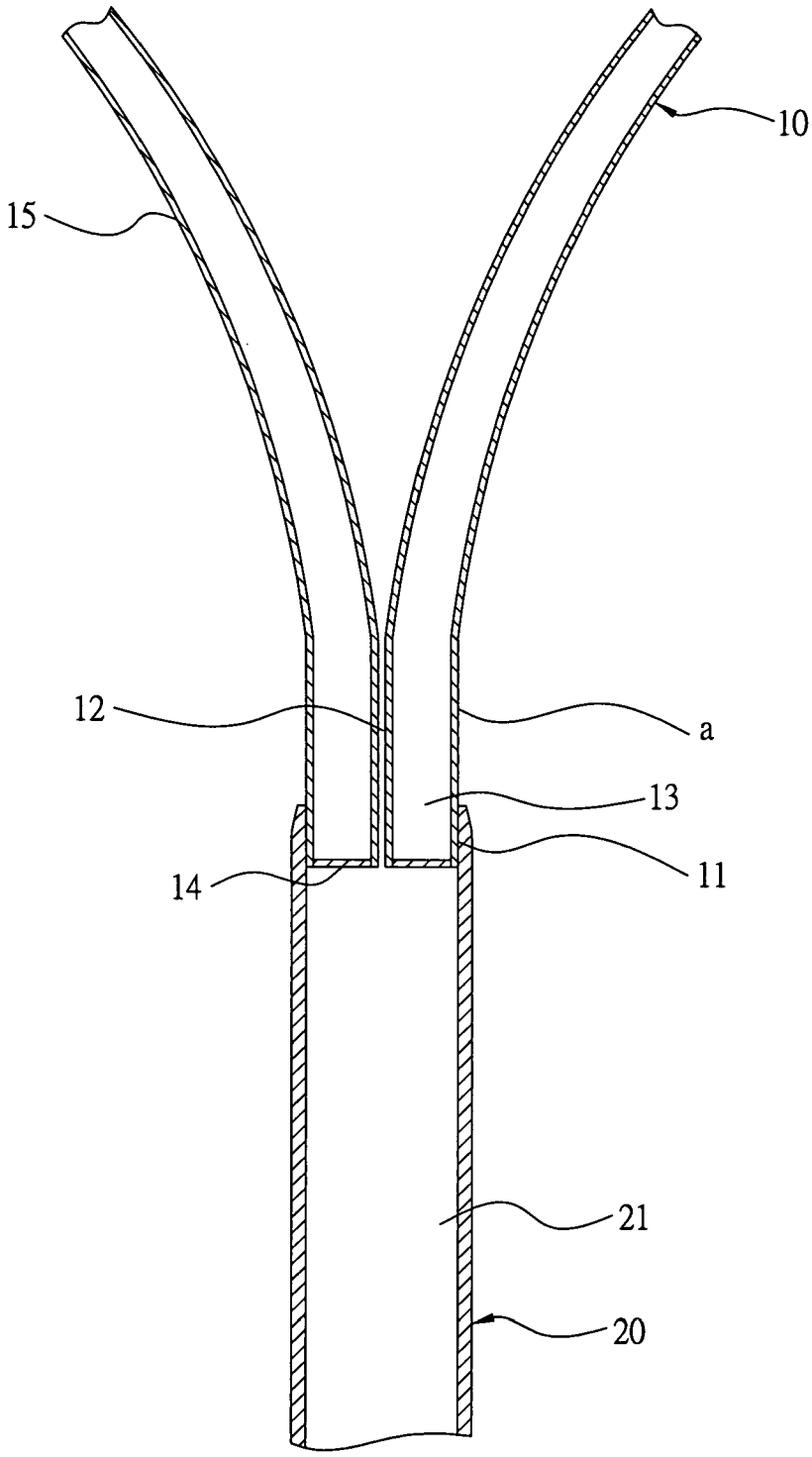
FIG. 2 is a front cross-sectional view of the lower combined portion of the metal racket frame fitted in the hollow grip in the present invention.

A preferred embodiment of a method for combining a metal racket frame with a grip in the present invention, as shown in FIGS. 1 and 2, includes the following steps.

Step 1: Prepare in advance a bent metal racket frame 10, a hollow grip 20 preset in shape, a proper amount of liquid resin 30 and a matched mold 40 consisting of an upper mold and a lower mold (only illustrated in the Figures). The metal racket frame 10 is properly bent by a mold and has its two lower ends 11 combined symmetrically, with a preset gap 12 formed between the two free ends 11. Then, the two free ends 11 of the metal racket frame 10 have their openings sealed up by means of resin 14 or adhesive tape.

Step 2: The two free ends 11 of the metal racket frame 10 are fitted in the upper end of the hollow 21 of the hollow grip 20, forming an overlapped section (a) at the fitted portion of the metal racket frame 10 and the hollow grip 20, as shown in FIG. 2.

Figure 3:
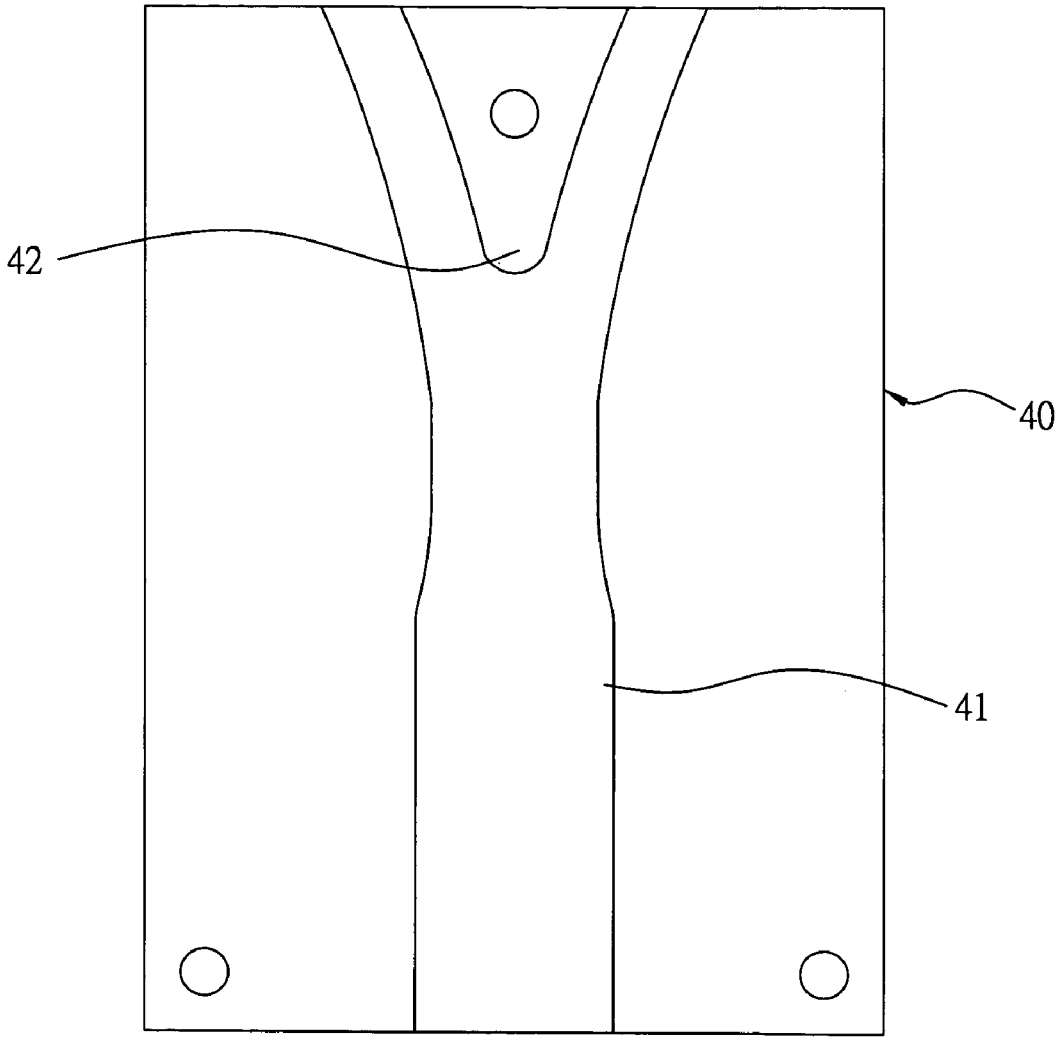
FIG. 3 is a front view of the lower cavity of a lower mold of opened matched molds in the present invention.
Figure 4:
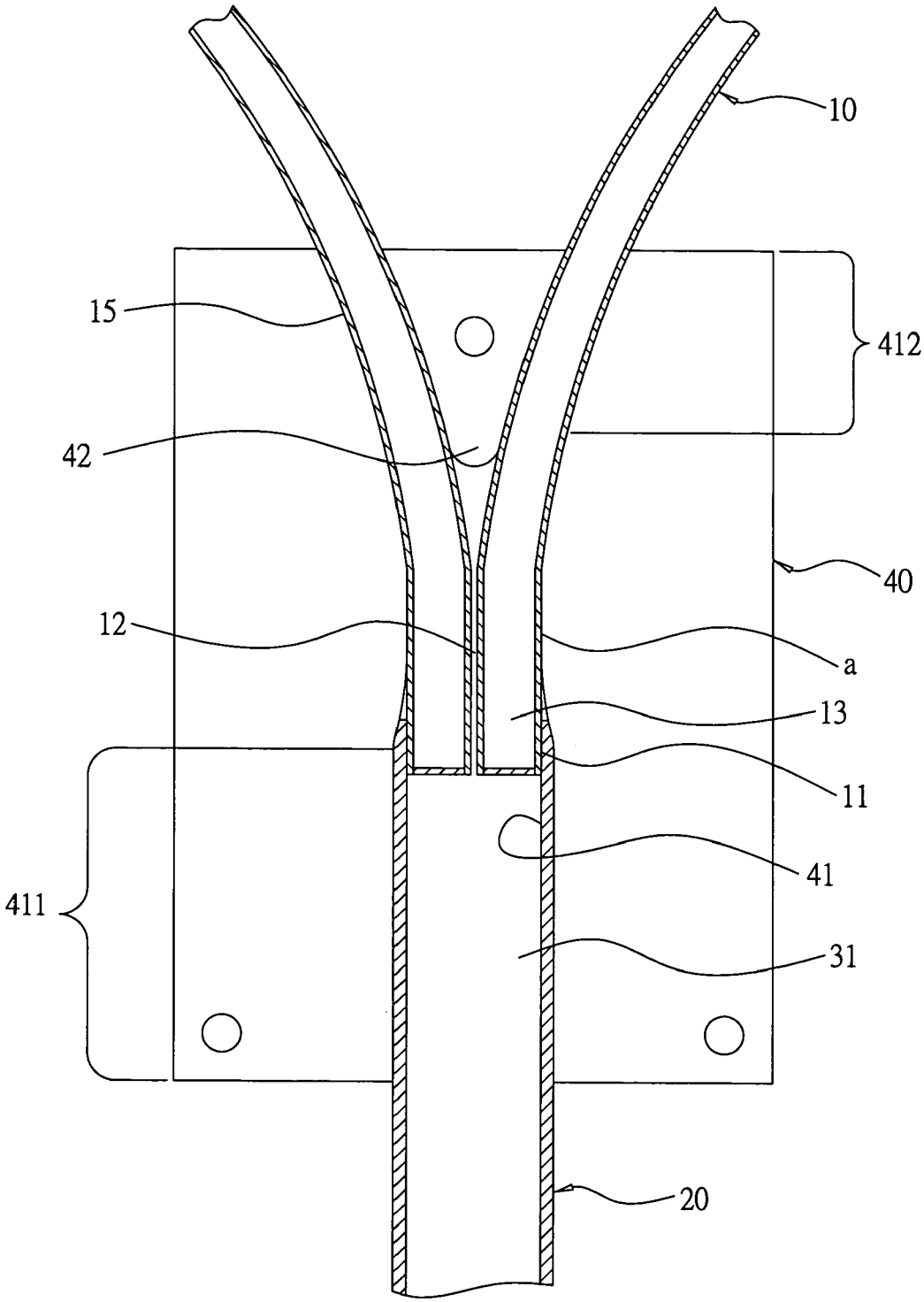
FIG. 4 is a cross-sectional view of the metal racket frame and the hollow grip having their combined portion placed in the cavity of the lower mold of the matched molds in the present invention.

Step 3: The overlapped section (a) of the metal racket frame 10 and the hollow grip 20 is placed in the matched mold 40, as shown in FIGS. 3 and 4 (only the lower mold shown). The lower sections 411 of the upper and the lower cavity 41 of the upper and the lower mold of the matched mold 40 forms a round hole of an inner diameter as large as the outer diameter of the hollow grip 20 when they are combined together, and the upper sections 412 of the upper and the lower cavity 41 of the upper and the lower mold of the matched mold 40 are V-shaped for receiving two ramified sections 15 near the two free ends 11 of the metal racket frame 10, having their upper edges closed. In addition, the upper and the lower cavity 41 are formed with a triangular sealing section 42 between the two ramified sections 15 of the metal racket frame 10, as shown in FIGS. 3 and 4.

Figure 5:
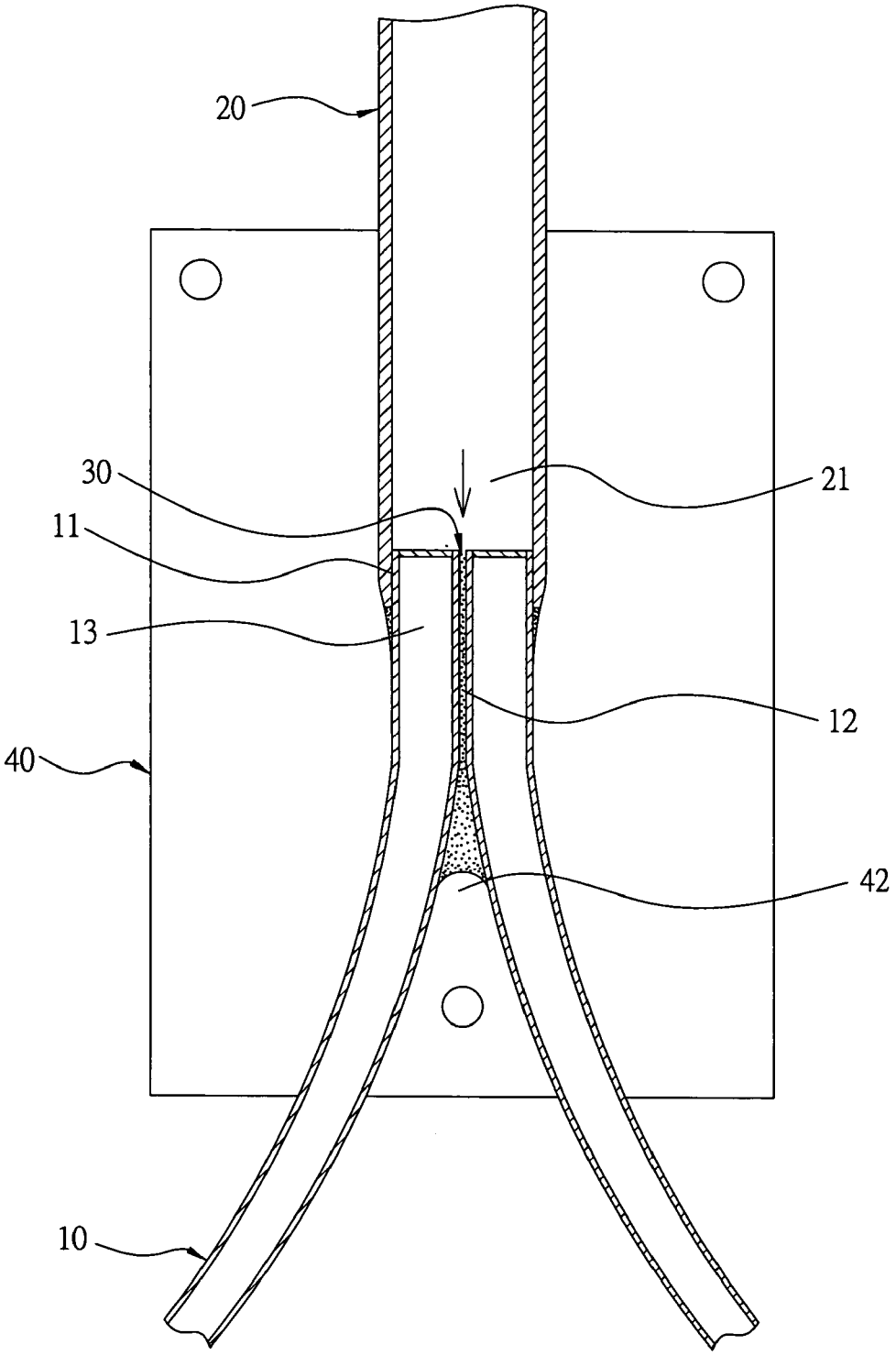
FIG. 5 is a cross-sectional view of the metal racket frame and the hollow grip having their combined portion placed in the cavity of the lower mold of the matched molds in the present invention, showing liquid resin being injected in the cavities.

Step 4: After the matched molds 40 are combined together, the matched mold 40 with the metal racket frame 10 and the hollow grip 20 are turned upside down, letting the hollow grip 20 face upward, as shown in FIG. 5.

Figure 6:
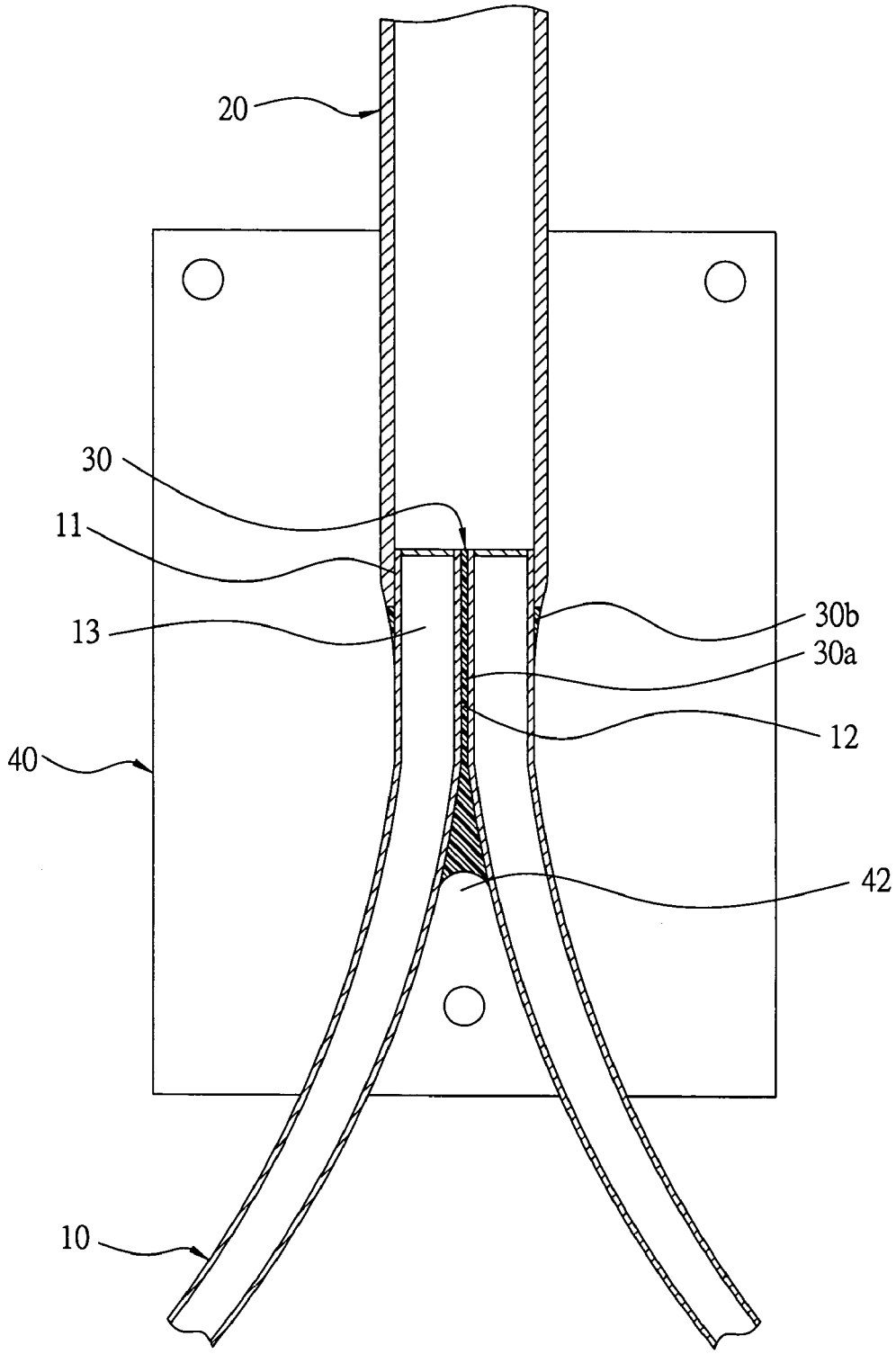
FIG. 6 is a cross-sectional view of the metal racket frame and the hollow grip having their combined portion placed in the cavity of the lower mold of the matched molds with the liquid resin filled around and solidified in the present invention.
Figure 7:
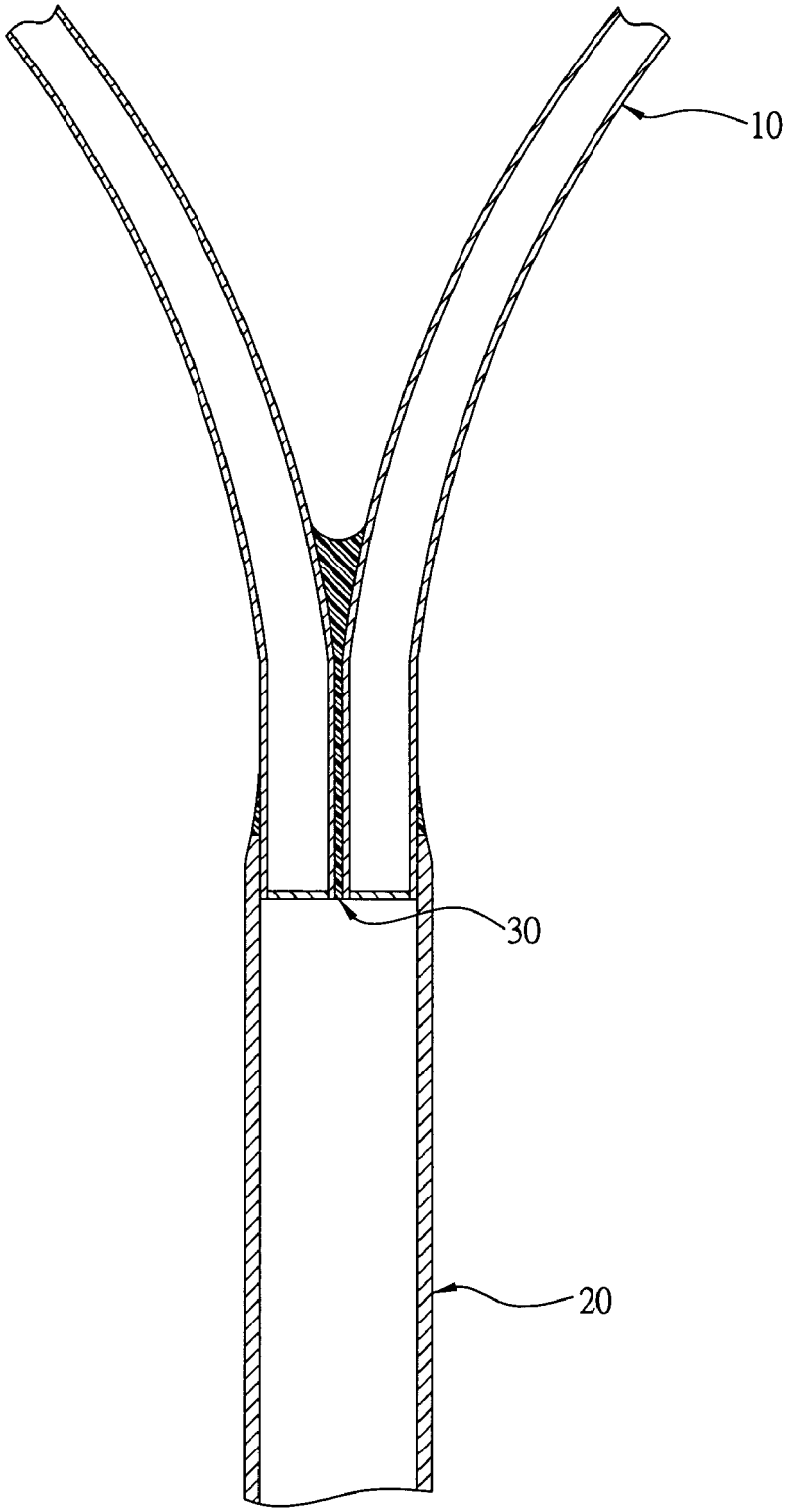
FIG. 7 is a partial cross-sectional view of the combined portion of the metal racket frame and the hollow grip with the resin solidified in the present invention.
Figure 8:
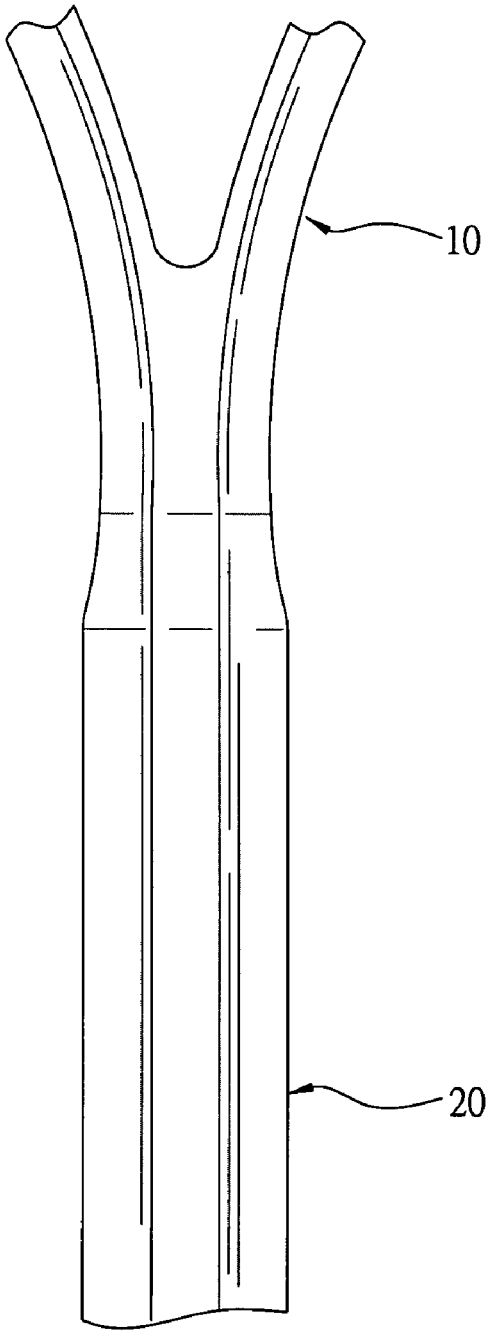
FIG. 8 is an outer view of the combined portion of the metal racket frame and the hollow grip in the present invention.

Step 5: As shown in FIG. 6, inject a proper amount of liquid resin 30 into the interior of the hollow grip 20, letting the liquid resin (30*a*) fill up the gap 12 between the two free ends 11 of the metal racket frame 10 as well as the space between the gap 12 and the triangular sealing section 42 and also letting the liquid resin (30*b*) fill up the outer circumferential sides of the two free ends 11 and the gap between the upper end of the hollow grip 20 and the inner wall of the upper and the lower cavity 41, as shown in FIG. 6.

Step 6: After the liquid resin 30 filled in the hollow grip 20 is solidified, open the matched mold 40 and remove the metal racket frame 10 together with the hollow grip 20 from the matched mold 40, thus the metal racket frame 10 and the hollow grip 20 combined together integrally and smoothly is finished.

As can be understood from the above description, this invention has the following advantages.

1. The hollow grip 20 only has a small part (about 10%) combined with the metal racket frame 10 by solidified resin 30, while the other part (about 90%) of the hollow grip 20 still remains hollow, greatly lightening the racket.

2. The racket of this invention is made by combining three different elements together, and the metal racket frame 10 and the hollow grip 20 are combined by means of elastic resin 30; therefore, vibration of the metal racket frame 10 caused by striking balls can be decreased, having an excellent effect of shock absorption.

3. The metal racket frame 10 and the hollow grip 20 are fitted together in a special way and then confined in the matched mold 40 and then combined with each other by high-pressured liquid resin 30 injected; therefore, they can be combined together integrally and smoothly.

While the preferred embodiment of the invention has been described above, it will be recognized and understood that various modifications may be made therein and the appended claims are intended to cover all such modifications that may fall within the spirit and scope of the invention.

I claim:

1. A method for combining a metal racket frame with a hollow grip comprising:

Step 1: Preparing in advance a metal racket frame, a hollow grip, a matched mold consisting of an upper mold with an upper cavity and a lower mold with a lower cavity, and a proper amount of liquid resin, said metal racket frame bent in advance by a mold, said metal racket frame having two free ends combined symmetrically, a preset gap formed between said two free ends, said two free ends having their openings sealed beforehand:

Step 2: fitting Said metal racket frame having said two free ends into the upper end of the hollow of said hollow grip, said metal racket frame and said hollow grip having their combined part formed with an overlapped section with a preset length:

Step 3: placing Said metal racket frame and said hollow grip having said overlapped section into a round hole of said matched mold, the lower sections of the upper and the lower cavity of said upper and said lower molds of said matched mold forming the round hole with an inner diameter as large as the outer diameter of said hollow grip when combined together, the upper sections of said upper and said lower cavities of said upper and said lower molds of said matched mold shaped as a V for receiving two ramified sections of said metal racket frame, said V-shaped section of said cavities of said upper and said lower molds of said matched mold having the upper ends closed, said upper and said lower cavities of said upper and said lower mold of said matched mold formed with a triangular sealing section between said two ramified sections of said metal racket frame:

Step 4: closing and combining together Said upper and said lower mold of said matched mold having the placed metal racket frame and hollow grip therein:

Step 5: Injecting the proper amount of said liquid resin in the interior of said hollow grip, said liquid resin filling up said preset gap between said two free ends and reaching said triangular sealing portion, said liquid resin also filling up a gap between the outer circumferential sides of said metal racket frame and the inner walls of said upper and said lower cavities: and Step 6: Opening the closed and combined together matched mold after said liquid resin is solidified, removing said metal racket frame together with the opened hollow grip from said matched mold, thus producing said metal racket frame and said hollow grip combined together integrally, firmly and smoothly.

2. The method for combining a metal racket frame with a hollow grip as claimed in claim 1, wherein after said matched molds are combined together, said matched molds and said metal racket frame together with said hollow grip are turned upside down, letting said hollow grip face upward to enable said liquid resin to flow downward after injected.

3. The method for combining a metal racket frame with a hollow grip as claimed in claim 1, wherein the upper edge of said hollow grip and the gap between the outer circumferential sides of said metal racket frame and the inner walls of said upper and said lower cavity of said upper and said lower mold of said matched mold are completely filled with said liquid resin.

4. The method for combining a metal racket frame with a hollow grip as claimed in claim 1, wherein said two free ends of said metal racket frame respectively have the opening sealed in advance by resin or adhesive tape.

* * * * *